United States Patent [19]

Maruyama et al.

[11] Patent Number: 4,753,678

[45] Date of Patent: Jun. 28, 1988

[54] SINTERED HARD METAL HAVING SUPERIOR TOUGHNESS

[75] Inventors: Masao Maruyama; Atsushi Seki; Masayoshi Yatabe; Kotaro Hagiwara, all of Hyogo, Japan

[73] Assignee: Sumitomo Electric Industries, Ltd., Osaka, Japan

[21] Appl. No.: 834,282

[22] Filed: Feb. 25, 1986

[30] Foreign Application Priority Data

Feb. 26, 1985 [JP] Japan ..... 60-36805

[51] Int. Cl.[4] ..... C22C 29/02; C22C 29/06

[52] U.S. Cl. ..... 75/238; 75/240; 75/241; 419/15; 419/16; 419/33; 419/49

[58] Field of Search ..... 75/237, 240, 241, 242, 75/238; 419/13, 14, 15, 18, 33, 49, 23, 16

[56] References Cited

U.S. PATENT DOCUMENTS

| | | | |
|---|---|---|---|
| Re. 21,730 | 2/1941 | Schwarzkopf | 75/242 |
| Re. 22,074 | 4/1942 | Schwarzkopf | 75/242 |
| Re. 22,166 | 8/1942 | Schwarzkopf | 75/242 |
| 2,026,958 | 1/1936 | Becker et al. | 75/242 |
| 2,166,795 | 7/1939 | Chelius | 75/242 |
| 2,246,387 | 6/1941 | Schwarzkopf | 75/242 |
| 3,752,655 | 8/1973 | Ranqvist | 75/242 |
| 4,013,460 | 3/1977 | Brown et al. | 419/18 |
| 4,097,275 | 6/1978 | Horvath | 419/15 |
| 4,145,213 | 3/1979 | Oskarsson et al. | 75/242 |
| 4,334,928 | 6/1982 | Hara et al. | 75/242 |
| 4,610,931 | 9/1986 | Nemeth et al. | 75/242 |

FOREIGN PATENT DOCUMENTS

| | | | |
|---|---|---|---|
| 718697 | 1/1932 | France | 75/242 |
| 57-76146 | 5/1982 | Japan | 75/242 |
| 57-98650 | 6/1982 | Japan | 75/242 |

*Primary Examiner*—John F. Terapane
*Assistant Examiner*—Eric Jorgensen
*Attorney, Agent, or Firm*—Eliot S. Gerber

[57] ABSTRACT

A sintered hard metal having superior toughness and superior hardness may be used for micro-drills, tools and wear resistant parts. The metal is a cemented carbide WC formed from tungsten carbide WC as the base alloy and containing 4 to 20 percent by weight of vanadium carbide VC or zirconium nitride. Its micro-structure is that the WC or WC-VC particles are 0.6μ or less, its Rockwell Hardness HRA is at least 91.5 and its transverse rupture strength is at least 350 kg/mm$^2$.

3 Claims, No Drawings

SINTERED HARD METAL HAVING SUPERIOR TOUGHNESS

BACKGROUND OF THE INVENTION

The present invention relates to a sintered hard metal and more particularly to cemented carbide having a superior toughness which may be utilized for micro-drills for drilling printed circuit boards, cutting tools, mining tolls and wear-resistant parts.

Tools made of cemented carbide, including WC-Co (tungsten carbide-cobalt) as a typical composition, are widely used in the machining field. The alloy compositions, characteristics, uses and applications of such cemented carbide materials are summarized in the "Cemented Carbide Tool Handbook" published by the Japan Cemented Carbide Tool Manufacturers Association on Sept. 10, 1976.

In WC-Co cemented carbide, a higher concentration of Co as a metal phase provides a higher transverse strength to increase the "toughness" transverse rupture strength, but lowers the hardness, i.e., decreases wear resistance. In order to improve such defects, TiC (titanium carbide) TaC (tantalum carbide), NBC, etc., are contained as a hard phase. As to cemented carbide commercially available on the market, however, the highest transverse rupture strength is about 300 to 320 kgs/mm$^2$ and the highest hardness HRA is about 80 to 85 (above-referenced Handbook, page 11, Table 1.6). That is, as the transverse strength is increased, the hardness is lowered; or as the hardness is increased, the transverse strength is lowered.

As to cemented carbide having a high hardness and a high toughness, the U.S. Pat. No. 3,480,410 discloses a WC-CrC-Co sintered composite having a toughness higher than that of normal WC-base cemented carbide and having a hardness higher than that of normal cemented carbide containing a large amount of Co. In the cemented carbide of the '410 patent, chromium carbide is present in the amount of 0.1 to 2.5 percent by weight, in the form of a complete dispersion of extremely fine grain size in the range of 0.2 micron, and the cobalt is present in a range of 9 to 20 percent by weight. The specification of the '410 patent describes that the alloy of its Example 1 has a Rockwell Hardness HRA of 91.7 and a transverse rupture strength of 315 kgs/mm$^2$ (unit conversion), and the alloy made in Example 2 has a Rockwell Hardness HRA of 90.5 and a transverse rupture strength of 353 kgs/mm2.

Micro-drills capable of drilling deep holes with a small diameter are increasingly needed for the precise drilling of printed electronic circuit board. There is a trend to use cemented carbide for such drills. An alloy having a higher hardness and higher toughness than that of conventional cemented carbide is therefore highly desirable. Micro-drills have a relatively long length compared to their diameter. Small-diameter drills, of 0.05 to 0.5 mm$\phi$, often cause fracture accidents when used in high-speed drilling. In order to enhance the rate of operation of machines, increased wear resistance of drills, and other parts subject to friction, is desirable.

SUMMARY OF THE INVENTION

In view of the foregoing, the present invention provides a cemented carbide having not only superior toughness and superior wear resistance, but also a relatively increased hardness compared to that of conventional cemented carbide. The cemented carbide, in accordance with the present invention, is a tungsten carbide WC-base alloy containing 4 to 20 percent by weight of vanadium carbide (VC) or zirconium nitride (ZrN) along with WC as a hard phase. As to the micro structure of the alloy, the cemented carbide, in accordance with the present invention, includes WC particles or WC-VC particles of 0.6$\mu$u or less, and has a Rockwell Hardness HRA of 91.5 or more and a transverse rupture strength of 350 kg/mm$^2$ Micro-drills made of the alloy of the present invention in such ranges are excellent in performance.

DETAILED DESCRIPTION OF THE INVENTION

The condition required to form the WC-base alloy in accordance with the present invention is that the particle size of WC as a hard phase is 0.6$\mu$ or less which is smaller than the conventional particle size of 0.6 to 3$\mu$. In this connection, the present invention uses WC containing 0.4 to 1.2 percent by weight of Cr which was adjusted to be uniform fine particles, according to the direct carburization method. It was found that the use of these fine particles of WC causes co-existing VC or ZrN to be finely dispersed. Such fine dispersion of the hard phase is notable when VC or ZrN is present in the amount of 0.2 to 8.8 percent by weight. An excessive amount of VC or ZrN causes the coarse grain hard phase to separate out to lower the transverse rupture strength. When a metal phase is present in the amount less than 4 percent by weight, the transverse rupture strength is decreased. When the metal phase is present in the amount more than 20 percent by weight, the hardness is remarkably decreased. The preferable range is from 10 to 15 percent by weight of the metal phase.

The alloy, in accordance with the present invention, is made by blending and grinding fixed amounts of fine particles of WC, VC and Co, pressing the mixture at 0.5 to 2 T/cm$^2$ and sintering the product in a vacuum atmosphere for one hour at about 1300 to 1450° C. After normal sintering is obtained an alloy having a transverse strength of 360 kgs/mm$^2$, or more, and a hardness HRA of 91 or more. Dependent on compositions, there are instances where treatment using a hot isostatic press (HIP) at 1000 mb and 1200° to 1350° C, after such sintering, produces an alloy having a high (superior) hardness and a high (superior) toughness. In general, the HIP treatment improves hardness and transverse rupture strength, thus producing advantageous results.

The hardness and the transverse rupture strength have been limited because there are instances, which seldom occur, where an alloy having an HRA hardness of 91 or more and a transverse strength of 350 kgs/mm$^2$ or more cannot be obtained even though the WC grain size, the VC concentration and the Co concentration are in the required ranges, due to factors which cannot be detected by usual physical means. For microdrills to be used for hard printed circuit boards, the HRA hardness is preferably 92 or more and the transverse rupture strength is preferably 400 kgs/mm2 or more.

EXAMPLE 1

In a direct carburization furnace, WC of particle size 0.5$\mu$ was made from a predetermined mixture of fine particles of W and carbon. 0.2 to 0.6 percent by weight of VC and 10 to 14 percent by weight of Co were mixed with the WC. The mixture was then pressed at 1 T/cm$^2$ and sintered in a vacuum atmosphere at 1400° C. for one hour. A portion of the product was subjected to HIP treatment at 1000 mb. and 1350° C. for one hour, thus forming cemented carbide. Sample pieces of 4 mm ×8 mm×25 mm were made from the cemented carbide by grinding. The transverse rupture strength by three points and the Rockwell Hardness HRA were measured. For the purposes of comparison, pieces of cemented carbide made according to the prior art, specified above, were measured in the same way. The results are shown in the table 1.

TABLE 1

| Samples | | Composition | Hardness HRA | Transverse Rupture Strength (kg/mm$^2$) | Remarks |
|---|---|---|---|---|---|
| Cemented carbide in accordance with the present invention | 1 | WC-0.6% VC-10% Co | 92.4 | 400 | HIP |
| | 2 | WC-0.4% VC-13% Co | 92.5 | 430 | HIP |
| | 3 | WC-0.4% VC-14% Co | 92.5 | 440 | HIP |
| | 4 | WC-0.2% VC-13% Co | 91.5 | 390 | Without HIP treatment |
| Prior art for comparison | A | WC-17% Co | 90.5 | 390 | Without HIP treatment |
| | B | WC-5% Co | 93.6 | 210 | Without HIP treatment |
| | C | WC-20% Co | 89.0 | 330 | Without HIP treatment |

EXAMPLE 2

Micro-drills having a diameter of 0.3 mm and a shaft length of 7 mm were made with the alloy B (of the prior art) and the alloy No. 3 (In accordance with the present invention) in Table 1 in Example 1. Drilling tests were conducted under the following conditions:

Drilling Conditions:

Number of revolutions: 80,000 RPM

Feed Speed: 1000 mm/min (0.0125 mm/rev)

Work piece: Two printed circuit boards of glass epoxy resin overlapped on each other with a face plate of bakelite applied to each of the boards.

The test results show that the drill of sample B was the 240th hole, while the drill of sample No. 3 exhibited wear at the blade tip at the 2000th hole, but was broken.

What is claimed is:

1. A sintered hard metal having superior toughness including cemented carbide containing tungsten carbide as the main component, 0.2 to 0.8 percent by weight selected from the group of vanadium carbide and zirconium nitride as a hard phase and 4 to 20 percent by weight of cobalt as a metal phase, wherein the grain size of said tungsten carbide is less than 0.$\mu$, the Rockwell Hardness HRA is 91 or more and the transverse rupture strength is 350 kgs/mm$^2$ or more.

2. A sintered hard metal as in claim 1 wherein the metal does not contain more than 1% by weight of material other than tungsten carbide, vanadium carbide and zirconium nitride and cobalt.

3. A sintered hard metal as in claim 1 wherein said metal is formed by grinding the said tungsten carbide, anadium carbide or zirconium nitride and cobalt to form ground particles, sintering the ground particles in a vacuum atmosphere and simultaneously pressing the ground particles in a hot isostatic press.

* * * * *